US007246877B2

(12) United States Patent
Shindo

(10) Patent No.: US 7,246,877 B2
(45) Date of Patent: Jul. 24, 2007

(54) INK JET PRINTING APPARATUS

(75) Inventor: Tatsuya Shindo, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 230 days.

(21) Appl. No.: 10/820,079

(22) Filed: Apr. 6, 2004

(65) Prior Publication Data

US 2004/0252158 A1 Dec. 16, 2004

(30) Foreign Application Priority Data

Apr. 7, 2003 (JP) ..... 2003-103160

(51) Int. Cl.
*B41J 2/165* (2006.01)
*B41J 2/45* (2006.01)

(52) U.S. Cl. ..... 347/35; 347/68

(58) Field of Classification Search ..... 347/30, 347/35

See application file for complete search history.

(56) References Cited

U.S. PATENT DOCUMENTS

| | | | | |
|---|---|---|---|---|
| 6,036,299 | A | 3/2000 | Kobayashi et al. | |
| 6,193,355 | B1 * | 2/2001 | Nakamura | 347/30 |
| 6,305,778 | B1 | 10/2001 | Kobayashi et al. | |
| 6,312,089 | B1 * | 11/2001 | Imai | 347/24 |
| 6,338,539 | B1 * | 1/2002 | Kobayashi et al. | 347/23 |
| 6,527,361 | B1 * | 3/2003 | Gotoh et al. | 347/30 |
| 6,561,637 | B2 * | 5/2003 | Hino | 347/92 |
| 6,604,817 | B2 | 8/2003 | Hirota et al. | |
| 6,701,593 | B2 * | 3/2004 | Lin et al. | 29/25.35 |
| 6,969,136 | B1 * | 11/2005 | Matsumoto et al. | 347/7 |

FOREIGN PATENT DOCUMENTS

| | | |
|---|---|---|
| EP | 0 850 765 A2 | 7/1998 |
| EP | 0 997 286 A1 | 5/2000 |
| JP | A-11-157102 | 6/1999 |
| JP | A-2001-246744 | 9/2001 |

* cited by examiner

*Primary Examiner*—Stephen Meier
*Assistant Examiner*—Shelby Fidler
(74) *Attorney, Agent, or Firm*—Reed Smith LLP

(57) ABSTRACT

An ink jet printing apparatus including an ink jet head including an ink ejecting portion and an ejection-energy generating portion operable to eject ink droplets from the ink ejecting portion, a purging device operable to discharge the ink from the ink ejecting portion, without an operation of the ejection-energy generating portion, for thereby performing a purging operation to improve an ink ejecting state of the ink jet head, and a controller operable to control the purging device for performing the purging operation, and to control the ejection-energy generating portion for performing a flushing operation to discharge the ink from the ink ejecting portion to improve the ink ejecting state. The controller includes a flushing control portion operable to control the ejection-energy generating portion such that ink ejecting actions in the flushing operation are performed in a plurality of intermittent cycles, with a non-ejection pause being inserted between two successive ones of the intermittent cycles. The non-ejection pause has a time duration longer than a period of each ink ejecting action.

14 Claims, 8 Drawing Sheets

INK JET PRINTING APPARATUS

The present application is based on Japanese Patent Application No. 2003-103160 filed on Apr. 7, 2003, the content of which is incorporated herein by reference.

BACKGROUND OF THE INVENTION

1. Field of the Invention

The present invention relates in general to an ink-jet printing apparatus, and more particularly to an ink jet printing apparatus which is improved in its flushing operation to recover the desired quality of printing.

2. Discussion of Related Art

An ink jet printer is known as an example of an ink jet printing apparatus arranged to eject droplets of an ink onto a recording medium such as a sheet of paper, for printing an image of the recording medium. In this ink jet printer, a head unit having at least one ink jet head is provided with an ink cartridge which accommodates the ink and which is installed on each ink-jet head such that the used ink cartridge is replaceable with a new one. In operation of the head unit, the ink is supplied from the ink cartridge to each ink jet head having ejection nozzles, so that a printing operation is performed by ejection of the ink droplets from selected ones of the ejection nozzles.

The ink jet printer of the type described above suffers from a problem that air bubbles or foreign materials remaining in ink flow passages disturb ejection of the ink from the nozzles, resulting in deterioration of the quality of printing. To solve this problem, there has been practiced a so-called "purging operation" wherein the ink is forcibly discharged from end portions of the ejection nozzles which are open in a nozzle surface of each ink jet head. This purging operation is implemented, upon initial ink supply to the ink jet head or replacement of the ink cartridge, or at a suitable time during use of the ink cartridge, by a manual operation of a switch by the user of the ink jet printer, or automatically when a predetermined condition for implementing the purging operation is satisfied. The purging operation is performed by pressure-tightly covering the nozzle surface with a suction cap, and applying a negative pressure to the interior space of the suction cap by operation of a suction pump, so that the ink is positively discharged by suction out of the ejection nozzles of the ink jet head through the suction cap.

The purging operation is followed by a wiping operation to wipe the nozzle surface, and a flushing operation in which the ink jet head is operated by application of a drive signal, to eject the ink droplets from the ejection nozzles, as in a normal printing operation of the ink jet printer. The flushing operation permits removal of the residual ink or foreign materials from the open end portions of the ejection nozzles if the residual ink or foreign materials have been forced into the open end portions during the wiping operation, and removal of air bubbles or foreign materials from the ink jet head if the air bubbles or foreign materials have been drawn into the ink jet head. The flushing operation is also effective to recover uniformity of meniscus of the ink in the open end portions of the ejection nozzles.

The ink cartridge used for supplying the ink to the ink jet head of the ink jet printer arranged as described above generally has an outer casing formed of a suitable material such as polypropylene, and a porous member which is disposed within the outer casing and which is impregnated with the ink. The interior of the outer casing is deaerated or degasified when the ink cartridge is shipped. When the ink cartridge is installed on the ink jet printer, the ink within the ink cartridge is exposed to the atmosphere through an opening of the ink cartridge, so that the air is gradually dissolved in the ink, and the ink is eventually saturated with the air.

During a purging operation on the ink jet head, small air bubbles are produced within the suction cap, as a result of a high rate of flows of the ink by suction. The ink containing the air bubbles are drawn from the ejection nozzles into the ink jet head, in the presence of a back pressure generated within the ink cartridge, due to a capillary force of the porous member. When the ink within the ink cartridge is highly deaerated, the air bubbles disappear as a result of rapid dissolution of the air bubbles in the ink. When the ink is saturated with the air as a result of gradual reduction of the deaeration, it takes a long time for the air bubbles to be totally dissolved in the ink. If a flushing operation is performed on the ink jet head immediately after a purging operation of the ink jet head, the flushing operation permits only a portion of the air bubbles to be discharged from the ink jet head, and tends to promote a growth of the residual air bubbles due to a pressure variation within the ink cartridge as a result of the flushing operation.

To solve the problem described just above, it has been proposed to estimate the time required for totally or considerably removing the air bubbles produced by the purging operation, and initiate the following flushing operation only after the estimated time has passed after the termination of the purging operation. An example of this solution is disclosed in U.S. Pat. Nos. 6,036,299A and 6,305,778B1.

Where the purging operation is performed using the same suction cap for a plurality of ink jet heads corresponding to respective different colors, flushing operations must be performed a considerably large number of times after the purging operation, in order to prevent mixing of the inks of different colors. In this case, the residual air bubbles tend to grow during the repeated flushing operations, even when the flushing operations are initiated the predetermined time after the purging operation.

SUMMARY OF THE INVENTION

The present invention was made to solve the problems discussed above. It is therefore an object of the present invention to provide an ink-jet printing apparatus which is capable of recovering the desired quality of printing by performing repeated flushing operations on an ink jet head.

The above object may be achieved according to the principle of the present invention, which provides an ink jet printing apparatus comprising: an ink jet head including an ink ejecting portion and an ejection-energy generating portion operable to eject droplets of an ink from the ink ejecting portion; a purging device operable to discharge the ink from the ink ejecting portion, without an operation of the ejection-energy generating portion, for thereby performing a purging operation to improve an ink ejecting state of the ink jet head; and a controller operable to control the purging device for performing the purging operation, and to control the ejection-energy generating portion for performing a flushing operation to discharge the ink from the ink ejecting portion to improve the ink ejecting state of the ink jet head. The controller includes a flushing control portion operable to control the ejection-energy generating portion such that ink ejecting actions in the flushing operation are performed in a plurality of intermittent cycles, with a non-ejection pause being inserted between two successive ones of the intermittent cycles, the non-ejection pause having a time duration longer than a period of each of the ink ejecting actions.

In the ink-jet printing apparatus of the present invention constructed as described above, the ink ejecting actions in the flushing operation are performed in a plurality of intermittent cycles such that a non-ejection pause of a time duration longer than the period of each of the ink ejecting actions in each cycle is inserted between the two successive ones of the intermittent cycles, so that each cycle of ink ejecting actions is followed by the non-ejection pause. This arrangement is effective to prevent a growth of the air bubbles in the ink, which would take place due to a pressure variation during the flushing operation if the ink ejection actions were continuously performed a large number of times without the non-ejection pause. Accordingly, the ink jet printer is capable of recovering the intended quality of printing by performing the flushing operation.

In a first preferred form of the ink jet printing apparatus of the invention, the time duration of the non-ejection pause is long enough to permit air bubbles in the ink in the ink jet head to be substantially entirely dissolved in the ink. For instance, the ejection-energy generating portion is operated to effect about 4000 ink ejecting actions in each cycle at a frequency of 4–10 kHz. In this instance, the time duration of the non-ejection pause is preferably about one second, for example.

In a second preferred form of the ink jet printing apparatus, each of the plurality of intermittent cycles includes the ink ejecting actions performed for a length of time during which air bubbles in the ink in the ink jet head do not grow to sizes so large as to disturb a normal ink ejecting operation of the ink jet head.

In a third preferred form of the ink jet printing apparatus, the flushing control portion includes a timer operable to measure the time duration of the non-ejection pause.

In a fourth preferred form of the ink jet printing apparatus, the flushing control portion is operable to control the ejection-energy generating portion such that each of the plurality of intermittent cycles includes a predetermined number of the ink ejecting actions.

In a fifth preferred form of the ink jet printing apparatus, wherein the flushing control portion is operable to control the ejection-energy generating portion such that the ink ejecting actions in each of the plurality of intermittent cycles are performed for a predetermined time duration.

The ink jet printing apparatus according to a sixth preferred form of the invention further comprises an ink cartridge for supplying the ink jet head with the ink. In this apparatus, the controller includes a time measuring portion operable to measure a time which has passed after installation of the ink cartridge on the ink jet head, and the flushing control portion is operable after the time measured by the time measuring portion has reached a predetermined threshold.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF THE PREFERRED EMBODIMENT

Figure 1:
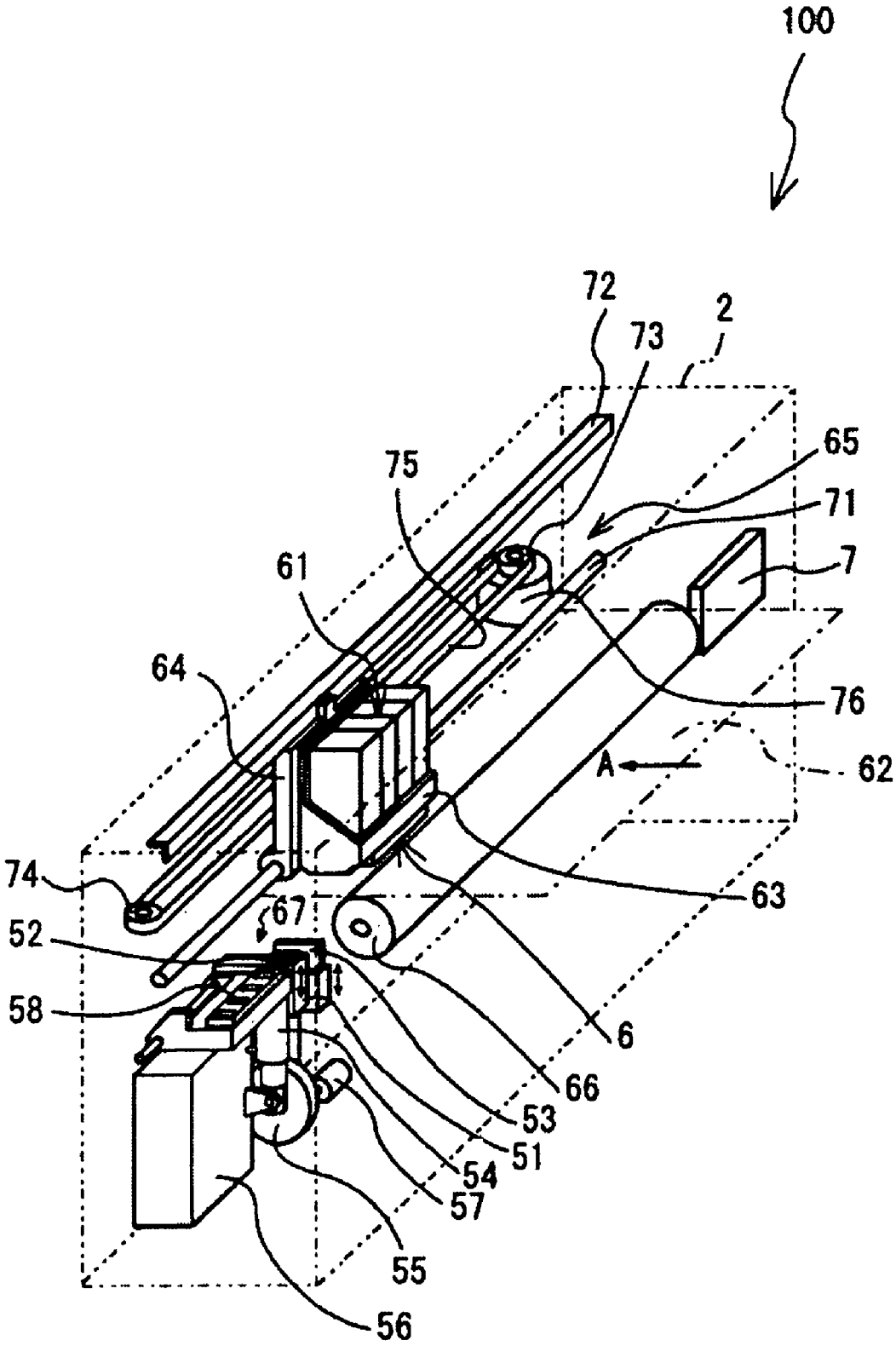
FIG. 1 is a perspective view of an ink-jet printer arranged according to a first embodiment of this invention.
Figure 2:
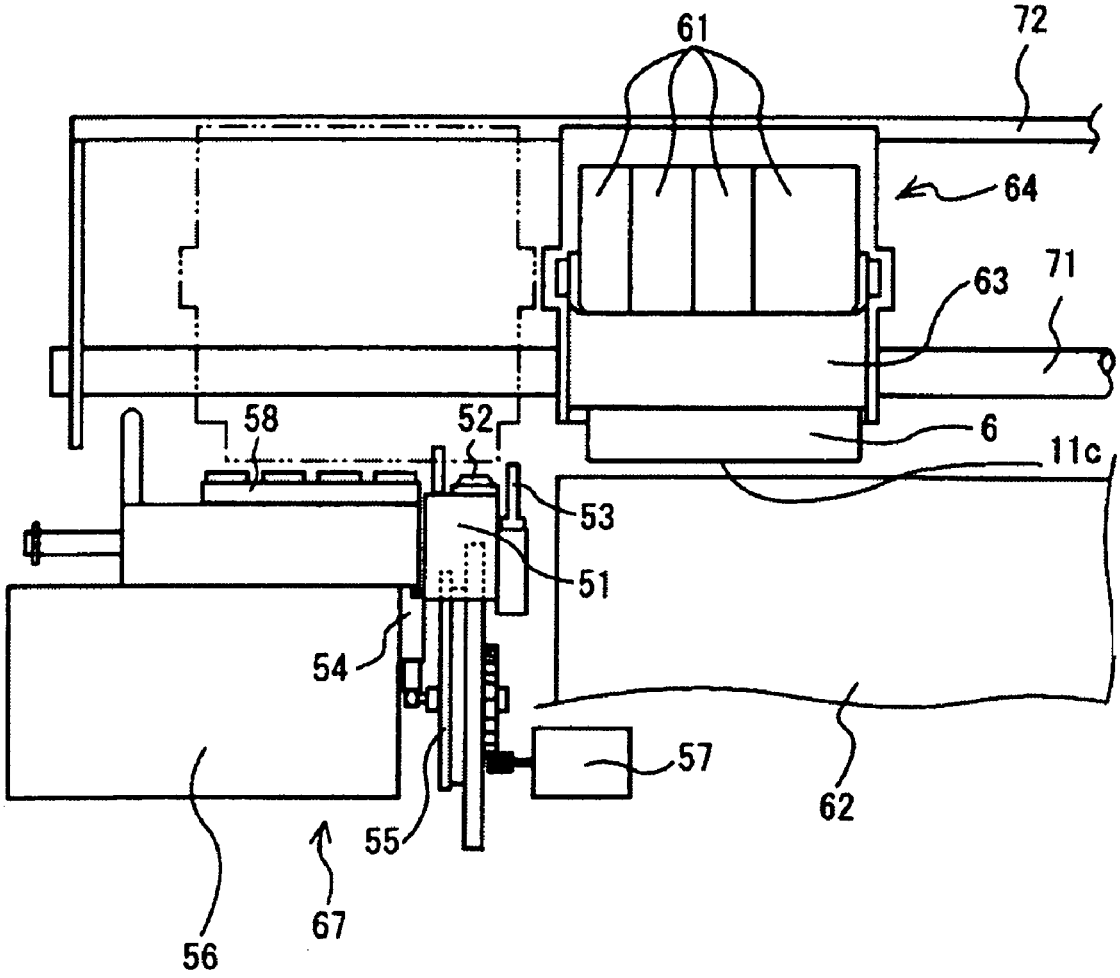
FIG. 2 is an enlarged front elevational view of a maintenance device of the ink-jet printer.

Referring first to FIGS. 1–5, an ink jet printing apparatus in the form of an ink jet printer 100 according to the first embodiment of the present invention. Initially, the overall arrangement of the ink jet printer 100 will be described by reference to the perspective view of FIG. 2 showing the printer 100, and the enlarged elevational view of FIG. 2 showing a maintenance device 67 provided on the ink jet printer 100.

As shown in FIG. 1, the ink jet printer 100 includes a head unit 63, a carriage 64, a drive unit 65, a platen roller 66 and the maintenance device 67 indicated above. The head unit 63 is provided with four ink cartridges 61 accommodating inks of respective four colors, for example, cyan, magenta, yellow and black, and four ink jet heads 6 of piezoelectric type operable to perform printing operations on a sheet of paper 62 while the paper sheet 62 is fed in a direction indicated by arrow A in FIG. 1. The carriage 64 carries the ink cartridges 61 and the head unit 63, and the drive unit 65 is operable to reciprocate the carriage 64 in a direction perpendicular to the feeding direction of the paper sheet 62. The platen roller 66 extends in the direction of reciprocation of the carriage 64, and is positioned in opposed relationship with the ink jet heads 6.

The drive unit 65 includes a carriage shaft 71, a guide plate 72, two pulleys 73, 74 disposed at respective ends of the carriage shaft 71 and guide plate 72, and an endless belt 75 connecting the two pulleys 73, 74. The carriage shaft 71 and guide plate 7 extend in parallel with the platen roller 66, and are provided to guide the carriage 64. The carriage shaft 61 is held in sliding engagement with a lower portion of the carriage 64. The pulley 73 is rotatable in opposite directions when a carriage drive motor 76 is operated in respective opposite directions, so that the carriage 64 connected to the endless belt 75 is linearly reciprocated along the carriage shaft 71 and guide plate 72, by the bi-directional rotation of the pulley 73.

In operation of the ink jet printer 100, a desired printing operation is performed on the paper sheet 62, with the ink droplets being ejected from the four ink jet heads 6 corresponding to the respective four colors, while the paper sheet 62 supplied from a sheet supply cassette (not shown) disposed on one side of the printer 100 is fed between the ink jet heads 6 and the platen roller 66, by a suitable sheet feeding mechanism (not shown in FIG. 1). The printed paper sheet 62 is received in a suitable sheet tray (not shown) by a suitable sheet ejecting mechanism (not shown). The sheet feeding mechanism includes a feed motor 77 operable to rotate the platen roller 66.

The maintenance device 67 indicated above is disposed in a left lower portion of the ink jet printer 100, as shown in FIGS. 1 and 2, and is operable to perform a maintenance operation on the ink jet heads 6. The maintenance device 67 includes: a sucking device 51 operable during use of the ink jet heads 6 to prevent ink ejecting failure or abnormality of ejection nozzles 15 (FIG. 3); protective caps 58 used to prevent drying of the ink while the ink jet printer 100 is not in operation; and a wiping member 53 operable to wipe a nozzle surface 11*c* (shown in FIG. 3) of each ink jet head 6. The above-indicated ink ejecting failure or abnormality of the ejection nozzles 15 may be caused by drying of the ink within the ink jet heads 6, generation of air bubbles within the ink jet heads 6, and deposition of the ink on the nozzle surface 11*c* in which the ejection nozzles 15 are open.

The sucking device 51 is provided with a suction cap 52 arranged for pressure-tight contact with the nozzle surface 11*c* of the two adjacent ink jet heads 6, as described below, such that the suction cap 52 can be released from the nozzle surface 11*c*. The sucking device 51 is further provided with a suction pump 54 operable to suck the ink from the ink jet heads 6 through the suction cap 52 held in the pressure-tight contact with the nozzle surface 11*c*. The maintenance device 67 further includes a cam member 55, and a cam drive motor 57 operable to drive the cam member 55, for moving the sucking device 51 toward and away from the two adjacent ink jet heads 6, in opposite directions indicated by arrows in FIG. 1. During an operation of the suction pump 54, the sucking device 51 performs a purging operation on the two ink jet heads 6 in question, through the suction cap 52, to discharge the ink containing air bubbles from the ink jet heads 6. The maintenance device 67 further includes an ink reservoir 56 for storing the waste ink discharged from the ink jet heads 6 by the purging operation. The ink reservoir 56 is formed of a felt or any other material highly capable of absorbing the ink.

As shown in FIG. 1, the present ink jet printer 100 has a frame structure 2, and is further provided with an ink receiver 7 at a right end portion of the frame structure 2, as seen in the figure. The ink receiver 7 functions to receive the ink ejected from the ink jet heads 6 during a flushing operation which is performed after the purging operation, as described below in detail. Like the ink reservoir 56, the ink receiver 7 is formed of a material highly capable of absorbing the ink.

Figure 3:
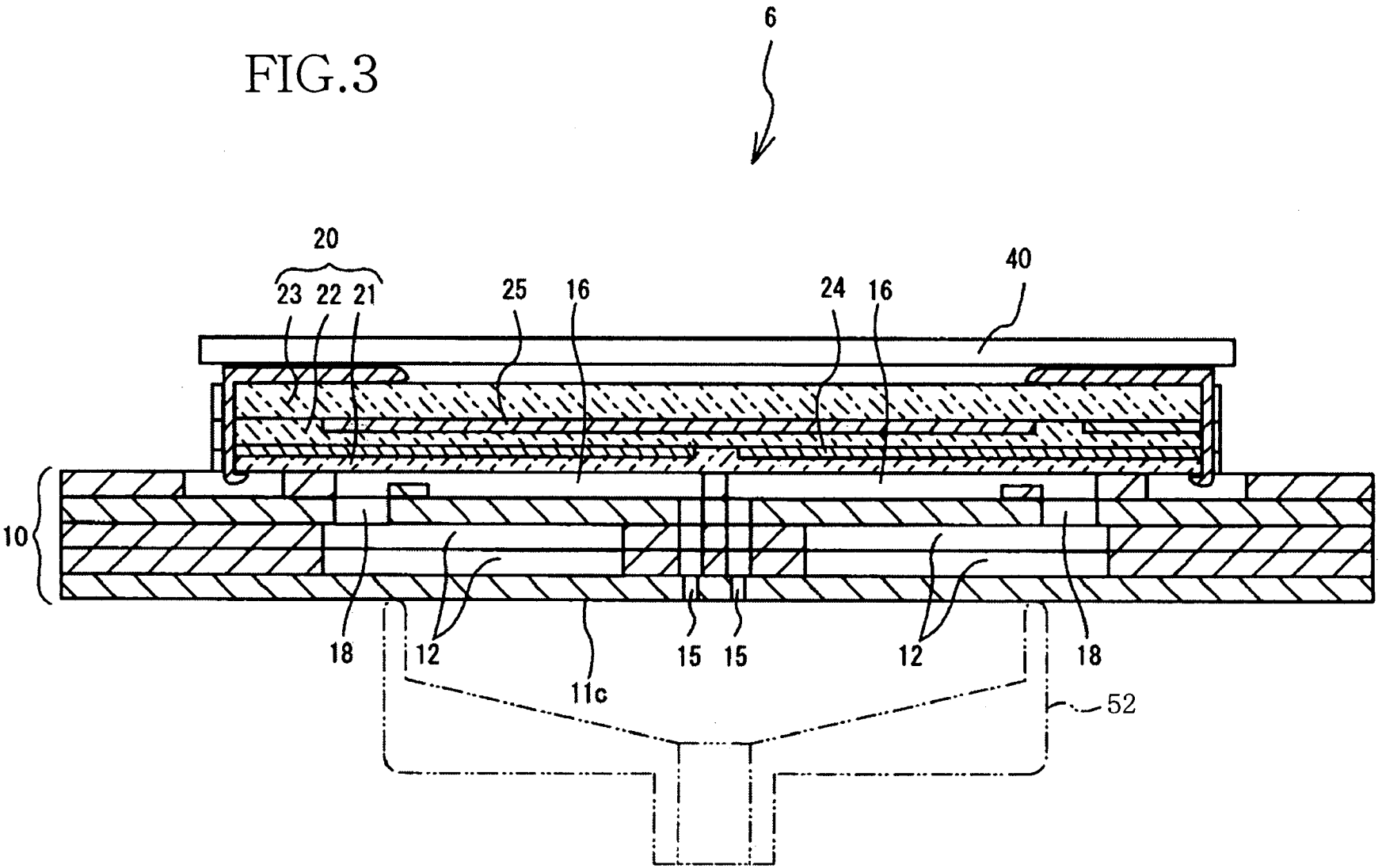
FIG. 3 is a side elevational view in cross section of ink jet heads of the ink-jet printer.

Referring next to the cross sectional view of FIG. 3, there are shown the two adjacent ink jet heads 6 of respective different colors which are formed substantially integrally with each other. Similarly, the other two adjacent ink jet heads 6 are formed substantially integrally with each other.

Each ink jet head 6 includes a cavity plate 10 having a plurality of metal places laminated on each other, and an ejection-energy generating portion in the form of a piezoelectric actuator 20 formed on the cavity plate 10, as disclosed in U.S. Pat. No. 6,604,817B2.

The cavity plate 10 has: a manifold chamber 12 to which the ink is supplied from the ink cartridge 61; a plurality of ink chambers 16 to which the ink is distributed through a communication hole 18; and an ink ejecting portion in the form of the ejection nozzles 15 corresponding to the ink chambers 16. Droplets of the ink are ejected from the selected ejection nozzles 15 when individual electrodes 24 of the piezoelectric actuator 20 which correspond to the selected ejection nozzles 15 are energized to apply a pressure to the corresponding ink chambers 16. The two adjacent ink jet heads 6 have the respective two straight rows of the ink chambers 16, and the respective two straight rows of the ejection nozzles 15. The above-indicated rows of the ink chambers 16 and the ejection nozzles 15 extend in a direction perpendicular to a plane of the view of FIG. 3. The ejection nozzles 15 of the two adjacent ink jet heads 6, which are arranged in the respective two rows, are open in the lower surfaces (nozzle surfaces 11*c*) of those ink jet heads 6.

The piezoelectric actuator 20 includes a plurality of piezoelectric ceramic sheets 21, 22, 23 which are laminated on each other, with the above-indicted individual electrodes 24 and a common electrode being sandwiched therebetween. In operation of the ink jet printer 100, a voltage is applied between the common electrode 25 and the selected ones of the individual electrodes 24, through a flexible wiring board 40 laminated on the upper surface of the piezoelectric actuator 20.

The piezoelectric actuator 20 may be replaced by any other type of actuator such as an actuator including heaters for heating the ink to eject the ink droplets, and an actuator utilizing static electricity to vibrate the walls of the ink chambers 16 for thereby ejecting the ink droplets.

As indicated by two-dot chain line in FIG. 3, the suction cap 52 is brought into pressure-tight contact with the lower surfaces or nozzle surfaces 11*c* of the two adjacent ink jet heads 6, such that the interior space of the suction cap 52 is held in communication with the two rows of the ejection nozzles 15. When the interior space of the suction cap 52 is evacuated by an operation of the suction pump 54, in a manner as well known in the art, the ink in the ink jet heads 6 is discharged. In this purging operation, the ink is bubbled in the interior space of the suction cap 52. When the suction pump 54 is turned off, the air bubbles within the interior space of the suction cap 52 are drawn into the ink jet heads 6, since a negative pressure generated by an ink supply source is applied to the ink within the ink jet heads 6, as in the conventional ink jet printer.

Although the air bubbles are gradually dissolved in the ink with a lapse of time, the air bubbles tend to grow, due to repeated application and removal of the pressure to and from the ink during a series of flushing operations following the purging operation, as known in the art. The air bubbles grown to considerably large sizes may close the ink flow passages, and disturb the ejection of the ink droplets from the ejection nozzles 15. The present ink jet printer 100 is provided with a controller arranged to solve this problem, as described below in detail.

Referring next to the block diagram of FIG. 4, there will be described an electrical arrangement of the ink jet printer 100. The four ink jet heads 6 are driven by respective four drive ICs 91, which are connected to a control circuit 87 of a controller 99 of the ink jet printer 100.

Figure 4:
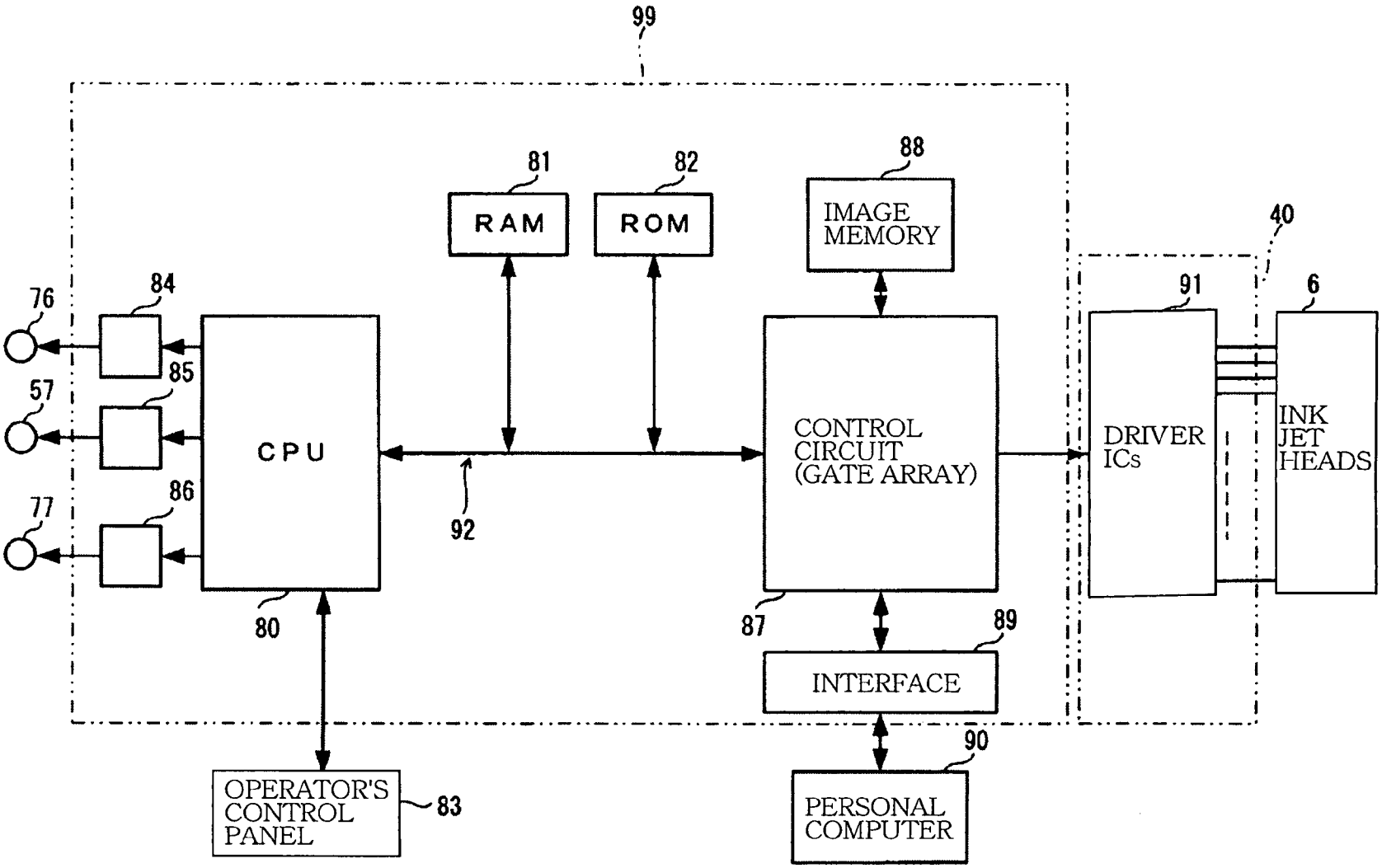
FIG. 4 is a block diagram showing an electrical arrangement of the ink-jet printer.

As shown in FIG. 4, the controller 99 (indicated by two-dot chain line) includes a one-chip CPU 80 operable to control the ink jet printer 100 as a whole, a RAM 81 and a ROM 82 connected to the CPU 80 through a bus 92. The RAM 81 is provided to temporarily store various kinds of data, while the ROM 82 is provided to store various control programs. The CPU 80 is connected to an operator's control panel 83 for entering various control commands, and to the carriage drive motor 76, the cam drive motor 57 and a feed motor 77 through respective driver circuits 84, 85 and 86. As described above, the carriage drive motor 76 is operable to reciprocate the carriage 64, and the cam drive motor 57 of the maintenance device 67 is operable to drive the cam member 55. The feed motor 77 is operable to rotate the platen roller 66 for feeding the paper sheet 62.

The above-indicated control circuit 87, which is constituted by a gate array, is also connected to the CPU 80 through the bus 92. To this control circuit 87, there are connected an image memory 88 for storing printing data, and an interface 89 for connection to an external personal computer 90. The control circuit 87 is further connected to the above-indicated driver ICs 91 provided on the flexible wiring board 40, so that ink ejection control signals are applied from the control circuit 87 to the driver ICs 91.

According to the ejection control signals received from the control circuit 87, the driver ICs 91 connected to the respective ink jet heads 6 apply drive voltages between the appropriate individual electrodes 24 and the common electrode 25 of the piezoelectric actuators 20 of the ink jet heads 6.

In operation of the ink jet printer 100 constructed as described above, the printing data transmitted from an external device such as the personal computer 90 are stored in an appropriate memory area of the image memory 88, under the control of the control circuit 87. The CPU 80 generates printing control signals according to the control programs stored in the ROM 82, and applies the generated printing control signals to the control circuit 87. According to the printing control signals received from the CPU 80, the control circuit 87 generate the ink ejection control signals on the basis of the printing data stored in the image memory 88, and applies the generated ink ejection control signals to the driver ICs 91, for controlling the operations of the ink jet heads 6.

Referring to the flow chart of FIG. 5, there will be described a maintenance routine to be performed in the ink jet printer 100 according to the first embodiment of the invention. The control program for performing this maintenance routine is stored in the ROM 82, and is executed by the CPU 80.

In the present ink jet printer 100, a predetermined maintenance operation according to the maintenance routine is performed immediately after the replacement of the ink cartridge 61, in the same manner as in the initial purging implemented upon initial operation of the printer. The maintenance operation is also performed by a manual operation of a purge pushbutton (not shown) provided on the operator's control panel 83, or by using a suitable software executed by the personal computer 90, when the user of the printer 100 recognizes a need to perform the maintenance operation, for example, when the user finds a local printing failure on the paper sheet 62. Further, the maintenance operation is automatically performed when a predetermined time has passed after the last maintenance operation, or when a predetermined number of printing operations have been performed. The purging operations are simultaneously performed on the two adjacent ink jet heads 6, with the suction cap 52 held in pressure-tight contact with the nozzle surfaces 11*c* of the two ink jet heads 6. Then, the purging operations are simultaneously performed on the other two adjacent ink jet heads 6 in the same manner. The flow chart of FIG. 5 illustrates the maintenance routine for each of the ink jet heads 6. On the other hand, the wiping operations are simultaneously performed on the four ink jet heads 6. The wiping operations are followed by the flushing operations which are simultaneously performed on the four ink jet heads 6 after the carriage 64 has been moved to a flushing position. However, the flushing operations may be simultaneously performed first on the first two adjacent ink jet heads 6, and then on the other two adjacent ink jet heads 6. Alternatively, the flushing operations may be sequentially performed on the four ink jet heads 6 in a predetermined order. Individual steps of the maintenance routine will be described in detail.

Figure 5:
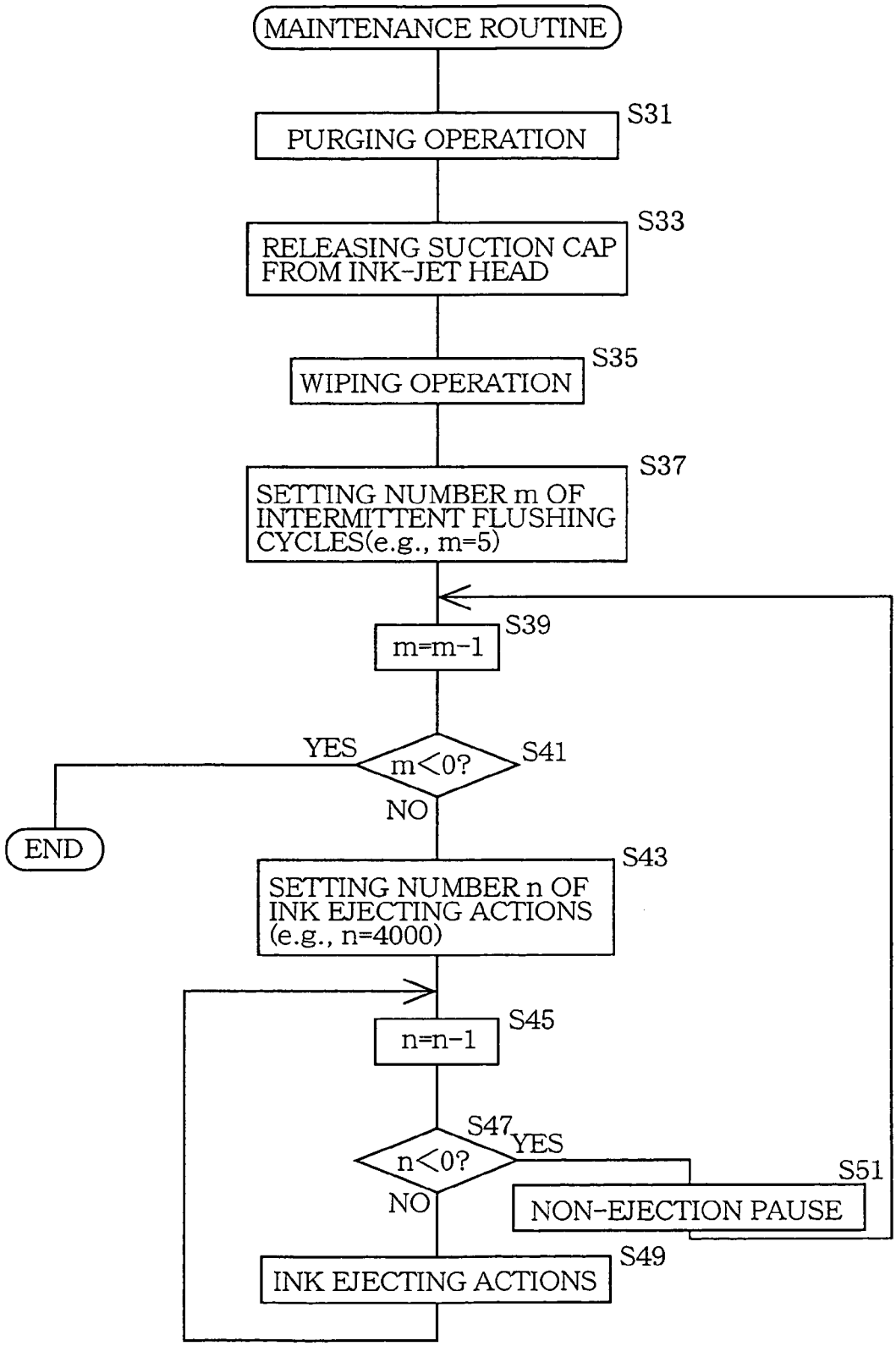
FIG. 5 is a flow chart illustrating a maintenance routine executed in the ink-jet printer of the first embodiment.

The maintenance routine of FIG. 5 is initiated with step S31 in which the purging operation is performed on each of the two adjacent ink jet heads 6. To perform the purging operations, the carriage 64 is moved to a predetermined purging position (indicated by two-dot chain line in FIG. 2) at which the nozzle surfaces 11*c* of the two adjacent ink jet heads 6 are located right above the suction cap 52 of the sucking device 51. Then, the cam drive motor 57 is operated to rotate the cam member 55, for thereby moving up the suction cap 52 for pressure-tight contact with the nozzle surfaces 11*c*. The suction pump 54 is then operated to simultaneously suck out the ink from the two rows of ejection nozzles 15. Step S31 is followed by step S33 in which the cam member 55 is further rotated to release the suction cap 52 from the nozzle surfaces 11*c*. Then, the control flow goes to step S35 in which the wiping member 53 is moved up, and the ink jet heads 6 to be wiped are moved to a predetermined wiping position so that the nozzle surface 11*c* of each ink jet head 6 is wiped by the wiping member 53. After the wiping operations are terminated, the wiping member 53 is lowered back to the original position, and the cam drive motor 57 of the maintenance device 67 is turned off.

Then, the flushing operation is performed in steps S37–S51. Described in detail, the ink jet head 6 to be subjected to the flushing operation is moved to the flushing position at which the ink jet head 6 is opposed to the flushing ink receiver 7. The ink jet head 6 is then operated so that the ink drawn into the ejection nozzles 15 due to the back pressure during the purging operations on the two adjacent heads 6 is discharged from the ejection nozzles 15. At this time, the piezoelectric actuator 20 is operated to effect ink ejecting actions for each ejection nozzle 15. The number of the ink ejecting actions is determined to be large enough to prevent mixing of the inks of different colors for the two adjacent ink jet heads 6 subjected to the purging operations in step S31. For example, 20000 ink ejecting actions are performed for each ejection nozzle 15. In the present embodiment, the ink ejecting actions are performed for the ejection nozzles 15 of one ink jet head 6 according to the maintenance routine of FIG. 5. However, the flushing operations (ink ejecting actions) may be simultaneously performed for the two rows of ejection nozzles 15 of the two adjacent ink jet heads 6 (subjected to the simultaneous purging operations), according to the maintenance routine of FIG. 5.

In the present embodiment, the 20000 ink ejecting actions are performed in five intermittent flushing cycles, with a non-ejection pause of one second being inserted between two successive ones of the intermittent flushing cycles, such that 4000 ink ejecting actions are performed at a predetermined frequency of 4–10 kHz in each cycle. The 20000 ink ejecting actions are divided into the five intermittent cycles each including the 4000 successive ink ejecting actions which are not considered to cause a critical amount of pressure variation within the ink jet head 6, which may cause a risk that the air bubbles remaining within the ink jet head 6 grow to sizes so large as to disturb the normal ink ejecting operation of the ink jet head 6. Further, the non-ejection pause of one second is considered to be long enough to permit the air bubbles to be dissolved in the ink, even though the air bubbles tend to grow due to the pressure variation during each flushing cycle. However, the dissolution of the air bubbles in the ink may be promoted as long as the time duration of the non-ejection pause is sufficiently longer than a period of each of the 4000 ink ejecting actions (longer than a time interval of the 4000 ink ejecting actions). That is, the time duration of the non-ejection pause may be determined to be sufficiently longer than a period of each of drive pulses to be applied to the piezoelectric actuator 20 to effect the 4000 ink ejecting actions at the frequency of 4–10 kHz. In the frequency range of 4–10 kHz, the period of each drive pulse ranges from $1/4000$ to $1/10000$ second.

Described more specifically, the ROM 82 stores a control program corresponding to a first number counting portion (steps S37, S39 and S41) operable to count the number m of the intermittent flushing cycles performed, a second number counting portion (steps S53, S45 and S47) operable to count the number n of the ink ejecting actions performed in each flushing cycle.

The flushing operation is initiated with step S37 to set the number m of the intermittent flushing cycles to "5". Step S37 is followed by step S39 to decrement the number m by "1". Then, step S41 is implemented to determine whether the present number m is smaller than zero. If a negative decision (NO) is obtained in step S41, the control flow goes to step S43 to set the number n of the ink ejecting actions performed in each cycle, to "4000". Then, steps S45, S47 and S49 are repeatedly implemented to perform the 40000 ink ejecting actions at the frequency of 4–10 kHz. That is, steps S45, S47 and S49 are repeatedly implemented until an affirmative decision (YES) is obtained in step S47 as a result of repeated decrementing operations of the number n in step S45. When the affirmative decision is obtained in step S47, the control flow goes to step S51 to provide the non-ejection pause of one second, and goes back to step S39 to initiate the second cycle of ink ejecting actions. When the five intermittent ink ejecting cycles have been performed, that is, when an affirmative decision (YES) is obtained in step S41 as a result of repeated decrementing of the number m, the present maintenance routine of FIG. 5 is terminated. Then, the ink jet printer 100 proceeds with the next operation such as a printing operation.

Referring next to the flow chart of FIG. 6, there will be described a maintenance routine according to a second embodiment of this invention. In this second embodiment, the flushing operation is not controlled based on the number of flushing cycles and the number of ink ejecting actions in each cycle, but is controlled based on a total flushing time and a time duration of each of ink ejecting cycles performed within the total flushing time. Steps S31–S35 in the second embodiment are identical with steps S31–S35 in the first embodiment of FIG. 5. The ROM 82 stores a control program corresponding to a first time counting portion (steps S7 and S9) operable to count the total flushing time p, and a second time counting portion (steps S11 and S13) operable to count the time duration q of each ink ejecting cycle.

Figure 6:
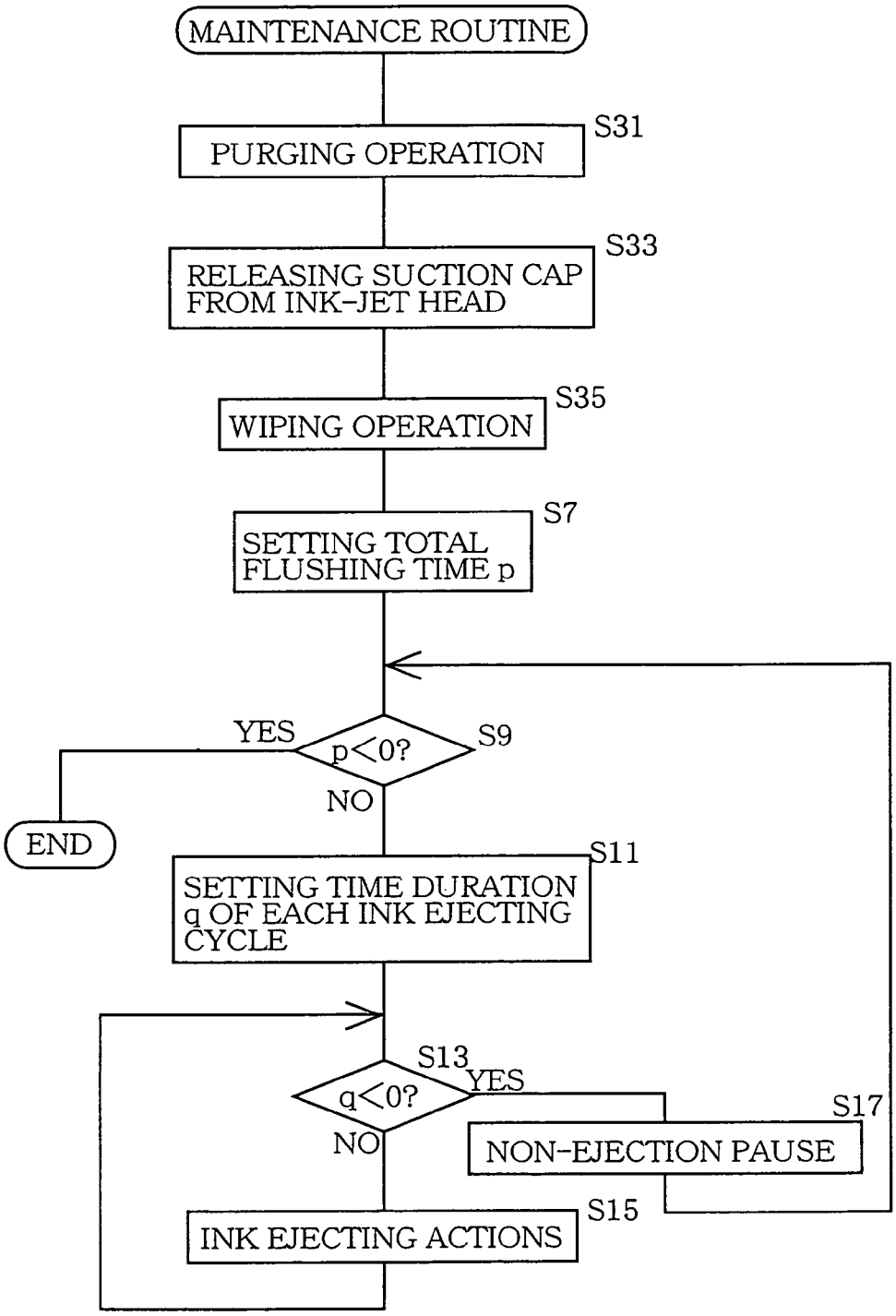
FIG. 6 is a flow chart illustrating a maintenance routine executed according to a second embodiment of this invention.

In the maintenance routine of FIG. 6, step S35 is followed by step S7 to set the total flushing time p. This total flushing time p is substantially equal to a sum of a time required for performing 20000 ink ejecting actions, and a total time (four seconds) of the four non-ejection pauses. Step S7 is followed by step S9 to determine whether the set total flushing time p has passed. If a negative decision (NO) is obtained in step S9, the control flow goes to step S11 to set the time duration q of each ink ejecting cycle consisting of a multiplicity of ink ejecting actions. In this embodiment, this time duration q corresponds to about 4000 ink ejecting actions. The ink ejecting actions are repeated at the predetermined frequency indicated above, until the set time duration q has passed. Namely, step S15 is repeatedly implemented to perform the ink ejecting actions until an affirmative decision (YES) is obtained in step S13, that is, until the set time duration q has passed. When the time duration q has passed, the control flow goes to step S17 to provide the non-ejection pause of one second, and goes back to step S9 to initiate the second ink ejecting cycle. The ink ejecting cycles are repeatedly performed until an affirmative decision (YES) is obtained in step S9, that is, until the set total flushing time p has passed. The present maintenance routine is terminated when the total flushing time p has passed.

The maintenance routines according to the first and second embodiments are arranged to insert the non-ejection pause between the two successive flushing or ink ejecting cycles. However, the maintenance routine may be arranged to insert the non-ejection pause only after a predetermined time has passed after installation (replacement) of the ink cartridge 61, and to perform the predetermined number of ink ejecting actions or repeat the ink ejecting actions for the predetermined total flushing time, without insertion of the non-ejection pause, before the predetermined time has passed. In this respect, it is noted that the degree of deaeration of the ink within the ink cartridge 61 is relatively high when a relatively short time has passed after the installation of the ink cartridge 61. Accordingly, while the time of use of the ink cartridge 61 is relatively short, the air bubbles in the ink are relatively rapidly dissolved in the ink, and the air bubbles are less likely to grow even if the flushing operation is continued for a relatively long time. While the time of use of the ink cartridge 61 is relatively long, the degree of deaeration of the ink is relatively low, and the air bubbles are less likely to be dissolved in the ink, so that the non-ejection pause is required to be provided between the two successive flushing or ink ejecting cycles. Examples of the above-indicated modification will be described by reference to the flow charts of FIGS. 7 and 8 illustrating maintenance routines according to third and fourth embodiments of the invention.

In the third and fourth embodiments, the ROM 82 stores a control program corresponding to a time measuring portion (step S77) operable to measure a time which has passed after the installation of the ink cartridge 61, and a determining portion (steps S79 and S85) to determine whether a PAUSE REQUIREMENT flag indicating that a predetermined time has passed after the installation is in an ON state. Steps S31–S35 and S37–S49 in the maintenance routine of FIG. 7 are identical with the corresponding steps in the first embodiment of FIG. 5, and steps S31–S35 and S7–S17 in the maintenance routine of FIG. 8 are identical with the corresponding steps in the second embodiment of FIG. 6.

Figure 7:
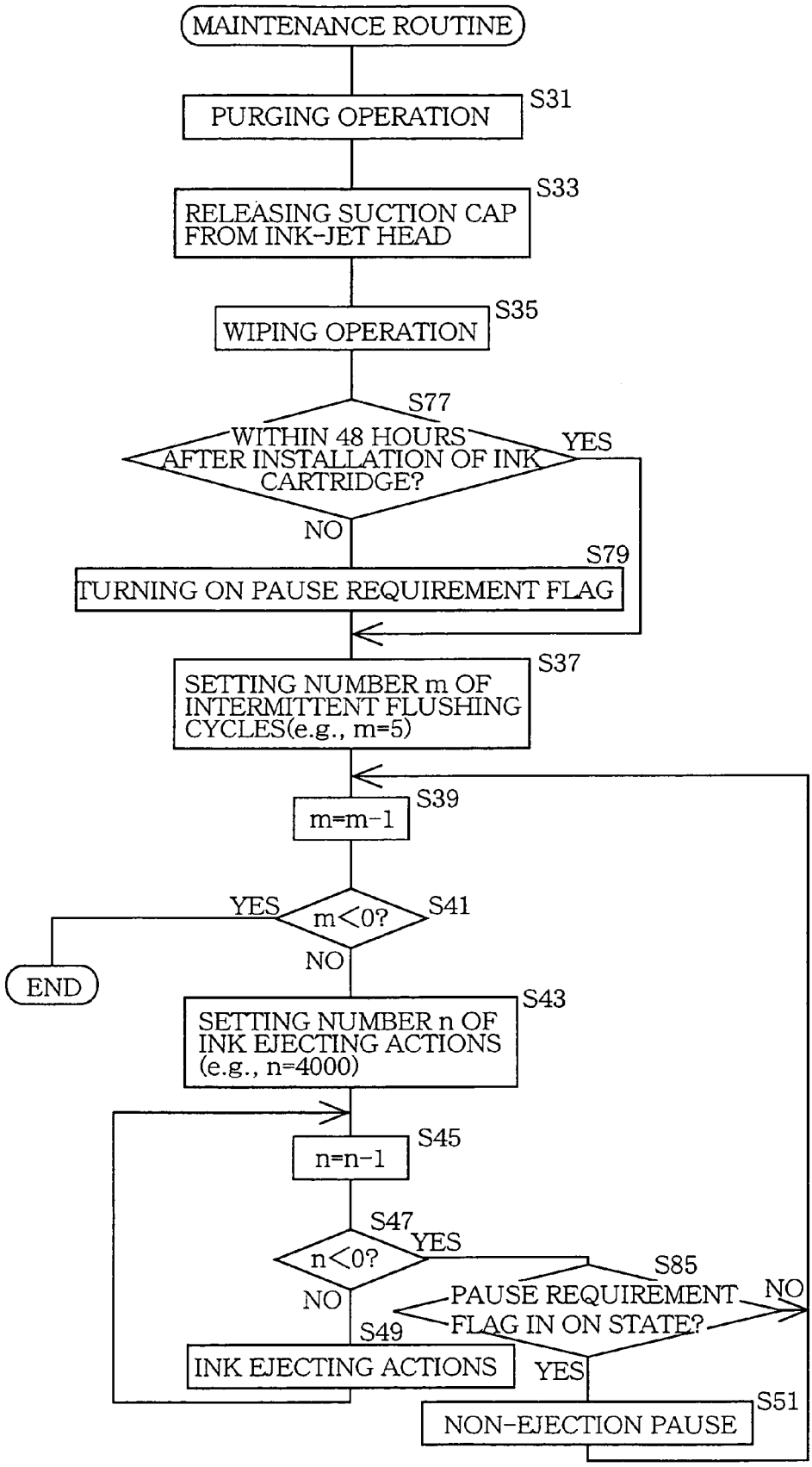
FIG. 7 is a flow chart illustrating a maintenance routine executed according to a third embodiment of this invention.
Figure 8:
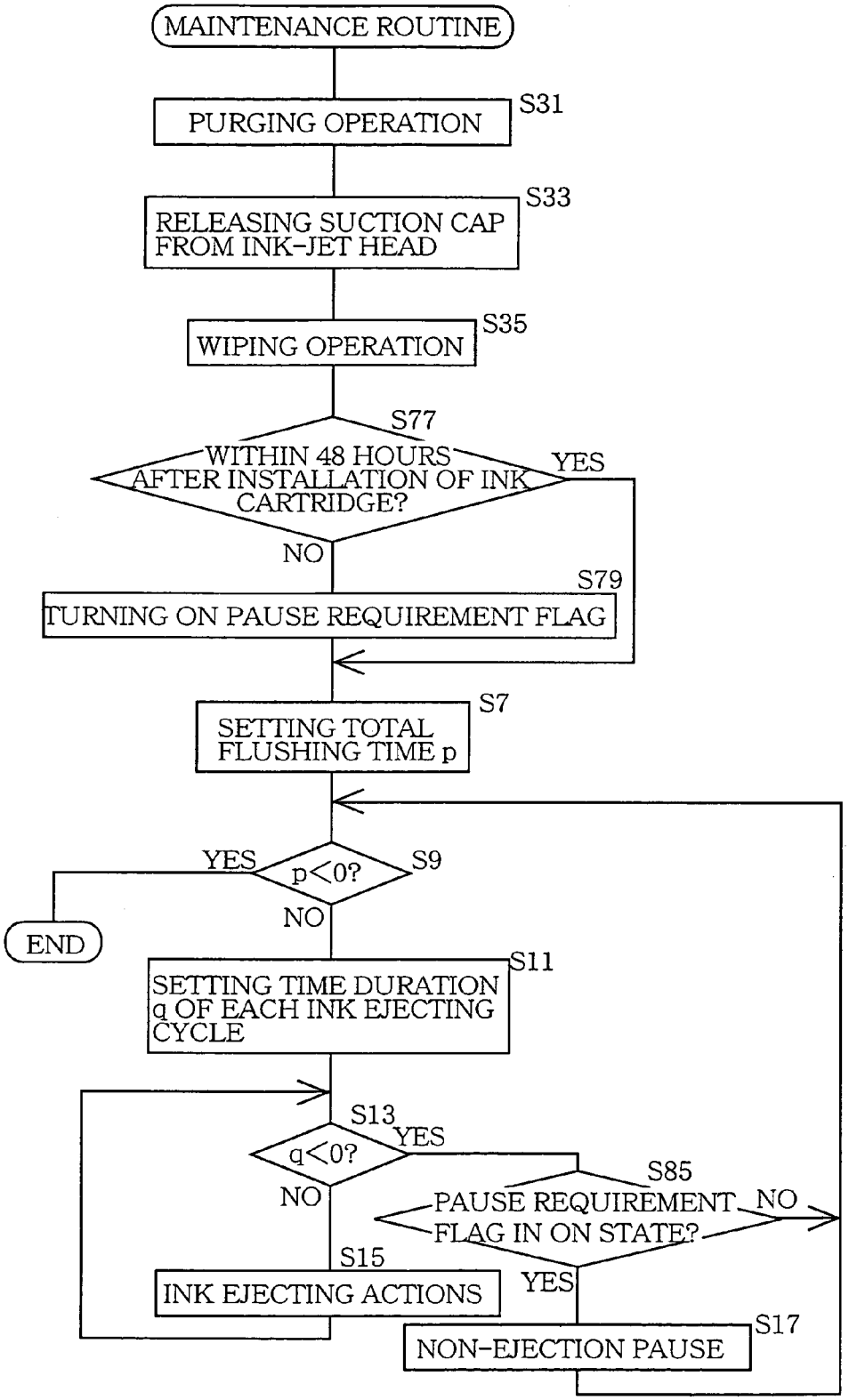
FIG. 8 is a flow chart illustrating a maintenance routine executed according to a fourth embodiment of this invention.

In the maintenance routines of FIGS. 7 and 8, step S35 is followed by step S77 to determine whether the measured time which has passed after the installation of the ink cartridge 61 is within a predetermined threshold time of 48 hours. If a negative decision (NO) is obtained in step S77, that is, if more than 48 hours have passed after the installation, the control flow goes to step S79 to turn on the PAUSE REQUIREMENT flag. In this case, an affirmative decision (YES) is obtained in step S85 provided to determine whether the PAUSE REQUIREMENT flag is in an ON state. Accordingly, each flushing or ink ejecting cycles consisting of the 4000 ink ejecting actions (steps S43–S49, or steps S11–S15) is followed by the non-ejection pause of one second in step S51 or S17 implemented when the affirmative decision is obtained in step S85. The PAUSE REQUIREMENT flag is reset to an OFF state when the used ink cartridge 61 is replaced by a new one.

While the measured time after the installation of the ink cartridge 61 is within 48 hours, that is, when an affirmative decision (YES) is obtained in step S77, the PAUSE REQUIREMENT flag is held in the initial OFF state, and a negative decision (NO) is obtained in step S85, so that each flushing or ink ejecting cycle (S43–S49, or S11–S15)is not followed by the non-ejection pause, but is followed by the next cycle, without the non-ejection pause being inserted between the two successive cycles. In this case, therefore, the predetermined number of intermittent flushing cycles are continuously performed in the embodiment of FIG. 7, or the ink ejecting actions are continuously performed for the predetermined total flushing time in the embodiment of FIG. 8.

Although the first through fourth embodiments have been described with particularity with respect to the ink ejection frequency, number of flushing cycles, number of ink ejecting actions in each cycle, total flushing time, time duration of each ink ejecting cycle, and threshold time after the installation of the ink cartridge 61, these and other parameters of the flushing operation may be determined or changed as needed depending upon the specific properties of the ink used, the specific construction of the ink jet head 6, and other factors of the ink jet printer 100.

In the ink jet printer 100 according to the illustrated embodiments described above, the ink ejecting actions to be performed in the flushing operation are divided into a plurality of intermittent flushing or ink ejecting cycles which are intermittently performed, with the non-ejection pause being inserted between the two successive intermittent cycles. The non-ejection pause is longer than the time required for each flushing or ink ejecting cycle to be completed. This arrangement is effective to prevent a growth of the air bubbles in the ink, which would take place due to a pressure variation during the flushing operation if the ink ejection actions were continuously performed a large number of time without the non-ejection pause. Accordingly, the ink jet printer is capable of recovering the intended quality of printing by performing the flushing operation.

It will be understood that a portion of the controller 99 assigned to implement steps S37–S41, S7–S17, S77, S78 and S85 constitutes a flushing control portion operable to control an ejection-energy generating portion in the form of the piezoelectric actuator 20 such that the ink ejecting actions in the flushing operation are performed in a plurality of intermittent cycles, with a non-ejection pause being inserted between two successive ones of the intermittent cycles, the non-ejection pause having a time duration longer than a time required for each of the ink ejecting actions in each cycle to be completed.

In the illustrated four embodiments, the time duration of the non-ejection pause is long enough to permit air bubbles in the ink in the ink jet head 6 to be substantially entirely dissolved in the ink. In this arrangement, the air bubbles if grown during the ink ejecting actions in each cycle can be substantially entirely dissolved in the ink during the non-election pause.

In the illustrated embodiments, each of the intermittent flushing or ink ejecting cycles includes of the ink ejecting actions performed for a length of time during which air bubbles in the ink in the ink jet head 6 do not grow to sizes so large as to disturb a normal ink ejecting operation of the ink jet head. Accordingly, the intermittent ink ejecting cycles permit the intended flushing operation without an excessive growth of the air bubbles in the ink jet head 6.

In the illustrated embodiments, a portion of the controller 99 assigned to implement step S51 constitutes a timer operable to measure the time duration of one second of the non-ejection pause. This arrangement permits easy prevention of an excessive growth of the air bubbles, and facilitate dissolution of the air bubbles in the ink.

In the first and third embodiments, the controller 99 controls the piezoelectric actuator 20 such that each of the plurality of intermittent flushing cycles consists of a predetermined number n of the ink ejecting actions In the second and fourth embodiments, the controller 99 controls the piezoelectric actuator 20 such that the ink ejecting actions in each of the intermittent ink ejecting cycles are performed for the predetermined time duration q. This arrangement permits the ink ejecting actions in each ink ejecting cycle, without an excessive growth of the air bubbles.

In the third and fourth embodiments, the CPU 80 of the controller 99 incorporates a time measuring portion operable to measure the time which has passed after installation of the ink cartridge 61 on the ink jet head 6, and the non-ejection pause is provided only after the time measured by the time measuring portion has reached a predetermined threshold of 48 hours. Namely, the flushing operation is continuously performed without any non-ejection pause, for a period shortly after the installation of the ink cartridge, since the air bubbles are less likely to be produced during this period. This arrangement permits efficient maintenance of the ink jet head and assures the desired quality of printing by the head, without an unnecessary insertion of the non-ejection pause in the flushing operation.

It is to be understood that the present invention is not limited to the illustrated embodiments, but may be otherwise embodied with various changes and modifications, which may occur to those skilled in the art, without departing from the spirit and scope of the invention defined in the following claims.

What is claimed is:

1. An ink jet printing apparatus comprising:

an ink jet head including an ink ejecting portion and an ejection-energy generating portion operable to eject droplets of an ink from said ink ejecting portion;

an ink cartridge for supplying said ink jet head with the ink;

a purging device operable to discharge the ink from said ink ejecting portion, without an operation of said ejection-energy generating portion, for thereby performing a purging operation to improve an ink ejecting state of said ink jet head; and a controller operable to control said purging device for performing said purging operation, and to control said ejection-energy generating portion for performing a flushing operation to discharge the ink from said ink ejecting portion to improve the ink ejecting state of said ink jet head, and wherein said controller includes a flushing control portion operable to control said ejection-energy generating portion in a first mode in which ink ejecting actions in said flushing operation are performed in a plurality of intermittent cycles, with a non-ejection pause which is inserted between two successive ones of said intermittent cycles and which has a time duration longer than a period of each of the ink ejecting actions, and a second mode in which said ink ejecting actions are performed continuously in one cycle without said non-ejection pause, wherein said flushing control portion further includes a time measuring portion operable to measure a time which has passed after installation of said ink cartridge of said ink jet head, said flushing control portion being operable in said first mode after the time measured by said time measuring portion has reached a predetermined threshold, and in said second mode before said time has reached said predetermined threshold.

2. The ink jet printing apparatus according to claim 1, wherein said time duration of said non-ejection pause is long enough to permit air bubbles in the ink in said ink jet head to be substantially dissolved in the ink.

3. The ink jet printing apparatus according to claim 2, wherein said flushing control portion controls said ejection-energy generating portion such that the ink ejecting actions in each of said plurality of intermittent cycles are effected at a frequency of 4–10 kHz.

4. The ink jet printing apparatus according to claim 3, wherein said time duration of said non-ejection pause is about one second.

5. The ink jet printing apparatus according to claim 2, wherein said time duration of said non-ejection pause is about one second.

6. The ink jet printing apparatus according to claim 1, wherein said flushing control portion activates said ejection-energy generating portion to perform said flushing operation after termination of said purging operation by said purging device.

7. The ink jet printing apparatus according to claim 1, wherein each of said plurality of intermittent cycles includes the ink ejecting actions performed for a length of time during which air bubbles in the ink in said ink jet head do not grow to sizes so large as to disturb a normal ink ejecting operation of said ink jet head.

8. The ink jet printing apparatus according to claim 1, wherein said flushing control portion includes a timer operable to measure said time duration of said non-ejection pause.

9. The ink jet printing apparatus according to claim 1, wherein said flushing control portion is operable to control said ejection-energy generating portion such that each of said plurality of intermittent cycles includes a predetermined number of the ink ejecting actions.

10. The ink jet printing apparatus according to claim 1, wherein said flushing control portion is operable to control said ejection-energy generating portion such that the ink ejecting actions in each of said plurality of intermittent cycles are performed for a predetermined time duration.

11. An ink jet printing apparatus comprising:

a head unit having a plurality of ink jet heads each including an ink ejecting portion and an ejection-energy generating portion operable to eject droplets of an ink from said ink ejecting portion;

a plurality of ink cartridges for supplying said plurality of ink jet heads with the ink;

a purging device operable to discharge the ink from said ink ejecting portions of two adjacent ones of said plurality ink jet heads, without operations of said ejection-energy generating portions of said two adjacent ink jet heads, for thereby performing a purging operation to improve ink ejecting states of said two adjacent ink jet heads; and a controller operable to control said purging device for performing said purging operation, and to control said ejection-energy generating portion for performing a flushing operation to discharge the ink from said ink ejecting portion of each of said two adjacent ink jet heads to improve the ink ejecting states of said two adjacent ink jet heads, and wherein said controller includes a flushing control portion operable to control said ejection-energy generating portion of said each of the two adjacent ink jet heads in a first mode in which ink ejecting actions in said flushing operation are performed in a plurality of intermittent cycles, with a non-ejection pause which is inserted between two successive ones of said intermittent cycles and which has a time duration longer than a period of each of the ink ejecting actions, and in a second mode in which said ink ejecting actions are performed continuously in one cycle without said non-ejection pause, wherein said flushing control portion further includes a time measuring portion operable to measure a time which has passed after installation of each of said plurality of ink cartridges on the corresponding ink jet head, said flushing control portion being operable in said first mode after the time measured by said time measuring portion has reached a predetermined threshold, and in said second mode before said time has reached said predetermined threshold.

12. The ink jet printing apparatus according to claim 11, wherein said purging device includes a suction cap arranged for a pressure-tight contact with the ink ejecting portions of said two adjacent ink jet heads.

13. An ink jet printing apparatus comprising:

an ink jet head of piezoelectric type having a plurality of ink chambers, a plurality of ejection nozzles, and a piezoelectric actuator operable to pressurize an ink in selected ones of said plurality of ink chambers, for ejecting droplets of the ink from the corresponding ejection nozzles;

an ink cartridge for supplying said ink jet head with the ink;

a purging device operable to discharge the ink from said plurality of ejection nozzles, without an operation of said piezoelectric actuator, for thereby performing a purging operation to improve an ink ejecting state of said ink jet head; and a controller operable to control said purging device for performing said purging operation, and to control said piezoelectric actuator for performing a flushing operation to discharge the ink from said plurality of ejection nozzles to improve the ink ejecting state of said ink jet head, and wherein said controller includes a flushing control portion operable to control said piezoelectric actuator in a first mode in which ink ejecting actions in said flushing operation are performed in a plurality of intermittent cycles, with a non-ejection pause which is inserted between two successive ones of said intermittent cycles and which has a time duration longer than a period of each of the ink ejecting actions, and a second mode in which said ink ejecting actions are performed in one cycle without a non-ejection pause, wherein said flushing control portion further includes a time measuring portion operable to measure a time which has passed after installation of said ink cartridge on said ink jet head, said flushing control portion being operable in said first mode after the time measured by said time measuring portion has reached a predetermined threshold, and in said second mode before said time has reached said predetermined threshold.

14. An ink jet printing apparatus comprising:

a head unit having a plurality of ink jet heads of piezoelectric type each having a plurality of ink chambers, a plurality of ejection nozzles, and a piezoelectric actuator operable to pressurize an ink in selected ones of said plurality of ink chambers, for ejecting droplets of the ink from said plurality of ejection nozzles;

a plurality of ink cartridges for supplying said plurality of ink jet heads with the ink;

a purging device operable to discharge the ink from said plurality of ejection nozzles of two adjacent ones of said plurality ink jet heads, without operations of said piezoelectric actuators of said two adjacent ink jet heads, for thereby performing a purging operation to improve ink ejecting states of said two adjacent ink jet heads; and a controller operable to control said purging device for performing said purging operation, and to control said piezoelectric actuator for performing a flushing operation to discharge the ink from said plurality of ejection nozzles of each of said two adjacent ink jet heads to improve the ink ejecting states of said two adjacent ink jet heads, and wherein said controller includes a flushing control portion operable to control said piezoelectric actuator of said each of the two adjacent ink jet heads in a first mode in which ink ejecting actions in said flushing operation are performed in a plurality of intermittent cycles, with a non-ejection pause which is inserted between two successive ones of said intermittent cycles and which has a time duration longer than a period of each of the ink ejecting actions, and in a second mode in which said ink ejecting actions are performed in one cycle without said non-ejection pause wherein said flushing control portion further includes a time measuring portion operable to measure a time which has passed after installation of each of said plurality of ink cartridges on the corresponding ink jet head, said flushing control portion being operable in said first mode after the time measured by said time measuring portion has reached a predetermined threshold, and in said second mode before said time has reached said predetermined threshold.

* * * * *